US008795207B2

(12) United States Patent
Cavallaro et al.

(10) Patent No.: US 8,795,207 B2
(45) Date of Patent: Aug. 5, 2014

(54) PORTABLE DEVICE FOR UPPER LIMB REHABILITATION

(75) Inventors: Ettore Cavallaro, San Sebastian (ES); Thierry Keller, San Sebastian (ES)

(73) Assignee: Fundacion Fatronik, San Sebastian (ES)

( * ) Notice: Subject to any disclaimer, the term of this patent is extended or adjusted under 35 U.S.C. 154(b) by 917 days.

(21) Appl. No.: 12/994,303

(22) PCT Filed: May 23, 2008

(86) PCT No.: PCT/ES2008/000365

§ 371 (c)(1), (2), (4) Date: Jan. 25, 2011

(87) PCT Pub. No.: WO2009/141460

PCT Pub. Date: Nov. 26, 2009

(65) Prior Publication Data

US 2011/0295165 A1 Dec. 1, 2011

(51) Int. Cl.
*A61H 1/00* (2006.01)

(52) U.S. Cl.
USPC ..... 601/33; 601/5; 601/23

(58) Field of Classification Search
USPC ..... 601/5, 23, 33, 34, 35
See application file for complete search history.

(56) References Cited

U.S. PATENT DOCUMENTS

| | | | | |
|---|---|---|---|---|
| 4,603,687 | A * | 8/1986 | Greenwood | 601/34 |
| 4,936,299 | A | 6/1990 | Erlandson | |
| 5,466,213 | A | 11/1995 | Hogan et al. | |
| 5,632,707 | A | 5/1997 | Daniel et al. | |
| 6,155,993 | A | 12/2000 | Scott | |
| 6,613,000 | B1 | 9/2003 | Reinkensmeyer et al. | |
| 7,311,643 | B2 | 12/2007 | Sheeks et al. | |
| 2005/0273022 | A1 | 12/2005 | Diaz et al. | |
| 2006/0079817 | A1 * | 4/2006 | Dewald et al. | 601/5 |
| 2007/0021692 | A1 | 1/2007 | Cornacchiari | |
| 2007/0066918 | A1 | 3/2007 | Dewald et al. | |

FOREIGN PATENT DOCUMENTS

| | | |
|---|---|---|
| CA | 2244358 | 1/2000 |
| DE | 2100467 | 7/1972 |
| JP | 2002272795 | 9/2002 |
| JP | 20048605 | 1/2004 |

(Continued)

OTHER PUBLICATIONS

International Search Report dated Apr. 23, 2009, from the corresponding PCT/ES2008/000365.

(Continued)

*Primary Examiner* — Quang D Thanh
(74) *Attorney, Agent, or Firm* — Katten Muchin Rosenman LLP

(57) ABSTRACT

The portable device for rehabilitating an impaired user having difficulties in executing simultaneous reaching and lifting tasks comprises an armrest whereto the forearm of the user can be fastened and mechanism for enabling the movement of the armrest on a surface. It furthermore comprises mechanism for monitoring the movement of the armrest and mechanism for sensing a force exercised by the arm of the user in an orthogonal direction to the surface. The device enables the user to conduct reaching movements in a large workspace having the forearm supported and fastened. The fact that the forearm is supported and fastened to the device allows for better control of the shoulder training movements, avoiding uncontrolled trajectories at the level of the elbow that are possible in case only a handle is grasped.

27 Claims, 4 Drawing Sheets

(56) References Cited

FOREIGN PATENT DOCUMENTS

| | | | |
|---|---|---|---|
| JP | 2007185325 | | 7/2007 |
| WO | 9961110 | | 12/1999 |
| WO | 2008050297 | A2 | 5/2008 |

OTHER PUBLICATIONS

International Preliminary Report on Patentability dated Jul. 15, 2010, from the corresponding PCT/ES2008/000365.
Darlene Hertling, et al., "Management of Common Musculoskeletal Disorders, Physical Therapy Principles and Methods", Fourth Edition, 2005, pp. xvii, 55-59, Lippincott Williams and Wilkins publishing.
Nancy Byl, et al., "Neurorehabilitation and Neural Repair, Effectiveness of Sensory and Motor Rehabilitation of the Upper Limb Following the Principles of Neuroplasticity: Patients Stable Poststroke", pp. 176-191, 2003 The American Society of Neurorehabilitation, vol. 17, No. 3.
"Heart Disease and Stroke Statistics" 2007 Update, American heart Association and America Stroke Association, pages Statistical Fact Sheets and 1-40.
Liesbet De Wit, et al., "Stroke", 2007; 38; pp. 2101-2107; Journal of the American Heart Association.
H.I. Krebs, et al., "Overview of clinical trials with MIT-MANUS: a robot-aided neuro-rehabilitation facility", Dec. 1999, pp. 419-423, Technology and Health Care 7 (1999) IOS Press.
Michael D. Ellis, Dpt, et al., "Modifiability of Abnormal Isometric Elbow and Shoulder Joint Torque Coupling After Stroke", pp. 1-16, NIH Public Access Author Manuscript, Muscle Nerve. Aug. 2005; 32(2): 170-178.

* cited by examiner

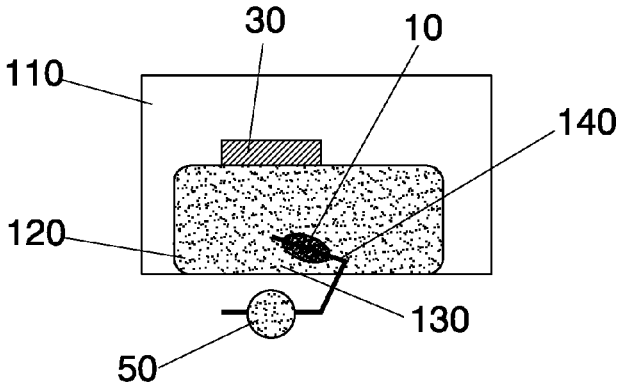
FIG. 7
FIG. 8
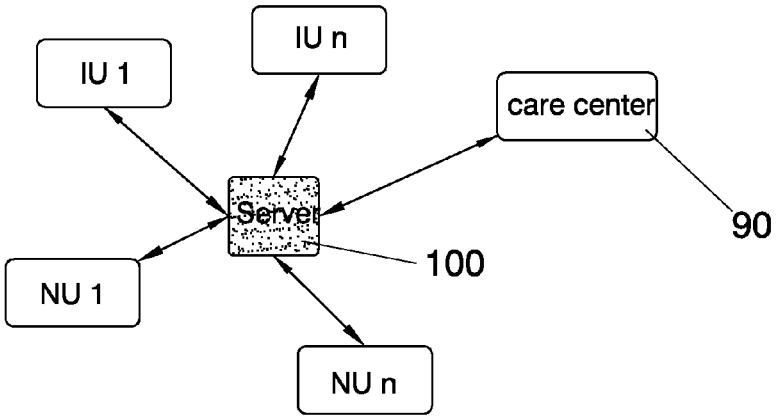
FIG. 9
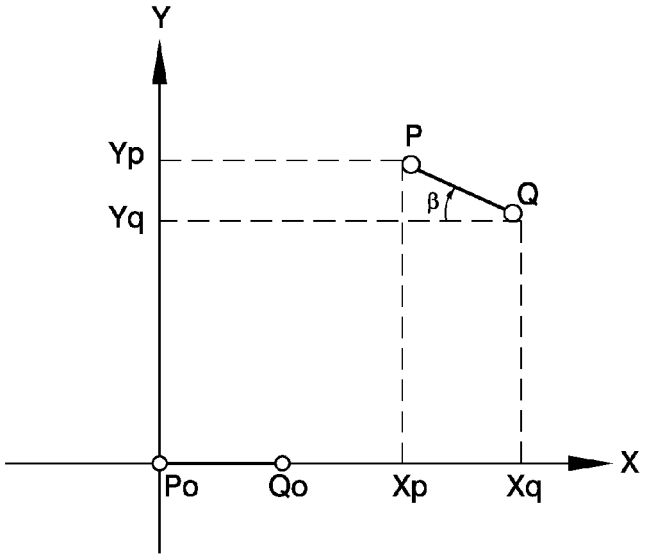

PORTABLE DEVICE FOR UPPER LIMB REHABILITATION

BACKGROUND OF THE INVENTION

1. Technical Field

The present invention relates to a portable device for rehabilitating an impaired user having difficulties in executing simultaneous reaching and lifting tasks. The device is in particular suitable for use in rehabilitation and/or physical therapy programs for the treatment of neuro-vascular or musculoskeletal injuries or diseases of the upper limb.

2. Description of Related Art

Hundreds of thousand of people are disabled each year because of upper limb motor impairments. Impairment can be due to neurological diseases such as stroke (see for example the 'Heart disease and stroke statistics 2007' published by the American Heart association and American stroke association), or can be due to musculoskeletal injuries. In both cases the disease can result in a decreased range of motion, muscular weakness, loss of speed and/or reduced coordination of the affected limb.

Physical therapy is known to be effective in reducing the degree of disability (Nancy Byl et al., Neurorehabilitation and Neural Repair, Vol. 17, No. 3, 176-191 (2003); Darlene Hertling, Lippincott Williams and Wilkins publishing, 2005). Recently published research work (Liesbet De Wit et al., Stroke. 2007; 38; 2101) confirm that better results in term of rehabilitation outcome are obtained in those care centers where patients receive more therapy per day for extended periods of time. Physical therapy is currently administered in hospital or specialized care-centers only. A physical therapist leads the patient trough a series of repetitive exercises during training sessions that are usually limited in number and duration because of the availability of therapists and cost. Moreover, it is usually difficult to assess the degree of impairment at the beginning of the therapy and to quantify the benefits of the treatments due to the lack of objective measurement techniques.

Robotic devices have the potential to improve this situation. An intelligent robot mechanically coupled with the arm of the patient can be used to help the patient carrying out exercises during the rehabilitation period, thus increasing the time spent in rehabilitation training. Moreover, the sensors of the robot can be used to asses the degree of the impairment at the beginning of the therapy cycle and to monitor the progresses.

In fact, a number of robotic devices have been developed in the past years for both academic and commercial purposes. For example, a 7 DoF powered upper limb exoskeleton has been developed at University of Washington, Seattle, USA as a rehabilitation/assistive device to tackle dysfunctions involving a loss of force in the upper limb. Researchers at Scuola Superiore Sant'Anna, Pisa, Italy developed the MEMOS system, a low cost 2 degrees of freedom Cartesian robot for motor recovery of upper limb after Stroke. The ACT 3D system has been developed at North-western University, USA, to create a virtual world for arm movement training during grasping and releasing tasks.

The research in academic environments has also generated a small number of commercial devices. For example, the MIT-Manus developed in the framework of academic research at MIT, Boston, USA and subsequently patented (U.S. Pat. No. 5,466,213 (1995)) is now commercialized by Interactive Motion Technology, USA, as the InMotion 1,2,3 devices for use in rehabilitation of shoulder, elbow and wrist.

Similarly, there is a number of patents submitted in the field. For example, Erlandson (U.S. Pat. No. 4,936,299 (1990)) describes an apparatus and method for rehabilitation that takes advantage of a robotic arm controlled by a CPU. Baker (patent No. CA 2 244 358 (2000)) describes a therapeutic wrist rotator for the rehabilitation of the wrist. Reinkensmeyer et al. (U.S. Pat. No. 6,613,000 (2003)) describe a computer based system that provides arm movement therapy for patients with sensory impairments that can operate over the World Wide Web and provide personalized programs of therapeutic exercise. Diaz et al. (U.S. Pat. No. 2005/0273022 A1 (2005)) describe a portable medical device for joint rehabilitation by means of continuous passive motion. Dewald et al. (U.S. Pat. No. 2007/0066918 A1 (2007)) describe a system for the rehabilitation of gravity-induced limbs coordination dysfunction after stroke or other neurological disorders.

Results from study and clinical trials conducted with robots such as the MIT-Manus show that the robotic mediated approach is safe, well accepted by patients and useful (see for example Krebs et al., Technol. Health Care 7, 6 (December 1999), 419-423).

However, the present generation of rehabilitation robots still presents several unsolved issues that prevent it from being used on a large scale. Among them, cost is an important one. The robotic device should be cheap enough to be widely adopted by care centers. Simplicity of use is also an issue in case the robotic device has to be used at home by the patients. The "use-at-home" feature asks also for portability of the device.

In fact, the devices and/or patents previously described can be roughly classified into two categories: (1) expensive and non-portable devices that can be used to implement a number of different rehabilitation programs given their complex structure; (2) simpler, more specialized devices that can be used for a restricted number of rehabilitation programs.

Several patents have been issued for such specialised devices. For example, US Pat. No. 2007/0021692 describes a system for performing induced limb movements. Hand or foot trajectories are recorded by means of position sensors, and the pressure exerted by the limb can be recorded.

WO Pat. No 99/61110 describes a system for the training of quick reach movements (feed forward movements). The system incorporates position measurement (hand, arm, joints), EMG measurement and feedback to the user.

U.S. Pat. No. 7,311,643 describes a portable upper limb and shoulder exercise board. It provides means to move a handle in a plane with a discretely variable friction coefficient.

JP Pat. No 2007185325 describes a system to perform reaching exercises on a table. The system is portable and provides means for measuring the position of a grip used by the subject and for measuring the force action on the grip. The position of the grip does not provide information on the configuration of the arm.

JP Pat. No. 2002272795 describes an upper limb rehabilitation device that includes a measurement of position and force exerted by the user on grip (transportation device), and feedback means. The system requires an instrumented table with tracks over which the transportation device can move.

JP Pat. No. 2004008605 describes a limb rehabilitation training apparatus. It provides means to measure the force exerted by a limb on a fixed device together with means to provide feedback to the user, such as video, sound, vibration).

It is an object of the invention to provide a simple and cost effective device enabling the user to conduct reaching movements in a large workspace

SUMMARY OF THE INVENTION

Thereto, according to an aspect of the invention a portable device according to independent claim 1 is provided. Favourable embodiments are defined in dependent claims 2-26.

The portable device for rehabilitating an impaired user having difficulties in executing simultaneous reaching and lifting tasks according to the present invention comprises an armrest whereto the forearm of the user can be fastened and means for enabling the movement of the armrest on a surface. It furthermore comprises means for monitoring the movement of the armrest, i.e. the position/velocity/acceleration and orientation thereof. It finally comprises means for sensing a force exercised by the arm of the user on the armrest in a direction orthogonal to the surface.

In the device according to the present invention simplification and cost reduction are introduced into the design. The proposed device is in fact a mobile robot instead of being a fixed device, a frame based device, or a device moving on a rail or track. Portability is thus improved. Moreover, it addresses the needs of special rehabilitation techniques by means of modularity.

The device according to the present invention, differently from the above described prior art devices, enables the user to conduct reaching movements in a large workspace having the forearm supported and fastened. The fact that the forearm is supported and fastened to the device allows for better control of the shoulder training movements, avoiding uncontrolled trajectories at the level of the elbow that are possible in case only a handle is grasped. At the same time, sensing the device position and rotation, given the fact that the forearm is fixed to the device, ensures a better quantitative assessment of the three dimensional position of the arm.

The device is designed for elbow and shoulder training, but can also be used for wrist and grasping training by adding specific modules. The number, duration, intensity and type of training session can be controlled by software running on the central processing unit of the device. The networking capabilities of the device according to a preferred embodiment of the invention enable its use in tele-rehabilitation environments, where the user and the physiotherapist are not in the same place, but the physiotherapist can monitor and change the rehabilitation program parameters at any time when it is required.

In the rehabilitation field, one of the problems, which is solved by means of the device according to the present invention, is related to the assessment and treatment of dysfunctions of the upper limb due abnormal synergies between shoulder abduction and elbow flexion activated by the weight of the limb itself. Chronic stroke patients are an example of impaired individuals presenting abnormal torque pattern generations. When an impaired subject tries to reach out far from the body and has to fully compensate the gravity acting on the limb, his/her reaching movement is unintentionally coupled with an elbow flexion. This prevents the subject from performing the reaching movement in a natural way. Nevertheless, it is demonstrated that motor learning capability is still present in chronic stroke patients, that could permit to regain a more functional pattern of shoulder and elbow activation (Ellis et al., Muscle Nerve. 2005 August; 32(2):170-8).

By means of the present invention a subject can perform reaching movements having the arm supported and the degree of lifting force he/she can exert measured, preferably by means of a force sensor. In a preferred embodiment the subject is also provided with a feedback about the position and orientation of the forearm, and of the lifting force exerted. He/she can then engage in reaching and lifting movements in order to accomplish some tasks represented in a virtual scenario that can be used to train his/her functional recovery of correct elbow/shoulder synergies. For example lifting force and position can be used to control two degrees of freedom in a game-like scenario displayed on a LCD screen. Thus, the invention can be used to provide a quantitative assessment of subject condition at the beginning of the rehabilitation training and to effectively provide training. Moreover, this result is achieved avoiding the use of articulated robots or cable suspended orthoses.

The invention provides a device and training and measurement methods to train or/and self-train and assist individuals having neurological or musculoskeletal disorders that result in the partial loss of the ability to move upper extremities. The device preferably is modular allowing different degree of system complexity/functionality to be achieved.

In one of its embodiments the device is a mobile robot of light weight and small size that is operated on a table (or any other suitable surface). The robot is equipped with a base platform having spherical wheels or regular wheels. An armrest is mounted on the base platform where the user can fasten his/her forearm. The armrest is connected to the robot base so that its height with respect to the base can be selected in a range of predetermined values. Moreover it is equipped with force/torque sensors so that at least the forces exerted by the user along the vertical axis can be measured and recorded. The mobile base is equipped with sensors, like optical tracking sensors, that enable the monitoring of position/velocity/acceleration of the robot and thereby of its armrest. The device comprises fastening means for fastening the forearm to the armrest, wherein the fastening means are selected from the group of: Velcro straps, pneumatic bracelets, and 3D printed bracelets adapted to single user forearm shape. A feedback interface, typically a video screen (but video, audio, haptic, or a combination of these could be used), is provided so the user can monitor his/her own activity. The device is part of a system equipped with a processing unit, a storage unit, and a wired/wireless communication unit.

The robot is designed so that it can be operated by the patients. An auxiliary system may be provided that remotely communicates with the robot trough a network protocol. This auxiliary system is designed to be used by medical staff and provides processing and data storage means together with proper software to analyze and interpret the data collected and sent by the robot during the rehabilitation sessions.

For the purpose of establishing the initial degree of impairment and to monitor patient improvement with the therapy, a measurement method may be implemented. The method relies on the measurement and recording of the movement of the mobile base of the robot and of the force/torques applied by the user on the armrest.

The rehabilitation training method takes advantage of software that interactively instructs the patient about the task to carry on by using the mobile robot. The patient continuously receives feedback about his/her performance in a sort of interactive game.

The type of exercise to be performed can be decided remotely by care center staff and/or constantly adapted to user performance.

The complete system may be modular, so the embodiment previously described can be integrated by add-ons to extend its functionality.

In one embodiment, actuators can be added to the mobile base in order to introduce an assisted (the user initiates the movement and the system help the user to complete it) or active (the system drives the user arm, in a safe way, through predetermined trajectories) displacement of the mobile robot on the table surface, so that force fields can be simulated.

In another embodiment the mobile unit does not have wheels, but a base that can be dragged on a pad. The friction between the pad and the mobile robot base can be varied by choosing the materials they are made of. For example Teflon on Teflon presents a static friction coefficient of 0.04.

In another embodiment, wrist pronosupination or radio-ulnar deviation training can be included by means of a suitably developed armrest device. Grasping training can be added in the same way.

In another embodiment, Functional Electrical Stimulation (FES) can be added to the capability of the system in order to improve therapy.

In another embodiment, EMG monitoring of the upper limb muscles can be added in order to provide the medical staff with more data about muscle activations so that the therapy can be adjusted accordingly.

In another embodiment, EEG monitoring can be introduced to provide the medical staff with information about the brain patterns of activation during the rehabilitation.

In another embodiment, a linear actuator can be added to the interface between armrest and mobile device along the vertical axis.

In another embodiment, a joint position measurement system can be integrated to the device to directly monitor the patient wrist, elbow and shoulder joints.

In another embodiment, a 3D position measurement system (such as for example the Fastrak Polhemus or Patriot and the likes) can be integrated to the device to directly monitor the patient wrist, elbow and shoulder joints.

In another embodiment, the spherical wheels are equipped with electrically controlled brakes, so that the effort required for moving the mobile robot can be controlled.

In another embodiment, there is a set of CMOS or CCD cameras that can be used to video monitor the training movements qualitatively and/or quantitatively (trajectories and/or angular positions of the limb).

In another embodiment, the mobile device is used on a pad. The pad can contain zones with different heights. The vertical position of the device is inferred by the planar position of the device together with a 3D software map of the pad.

These and other aspects of the invention will be apparent from and elucidated with reference to the embodiments described hereinafter.

BRIEF DESCRIPTION OF THE DRAWINGS

The invention will be better understood and its numerous objects and advantages will become more apparent to those skilled in the art by reference to the following drawings, in conjunction with the accompanying specification, in which:

FIG. 7 shows a schematic view of a possible use case of the device depicted in FIG. 1.

FIG. 8 shows a block diagram of the concept of concurrent rehabilitation.

FIG. 9 shows the position and orientation calculation of the portable device.

Throughout the figures like reference numerals refer to like elements.

DETAILED DESCRIPTION OF THE PRESENT INVENTION

Figure 1:
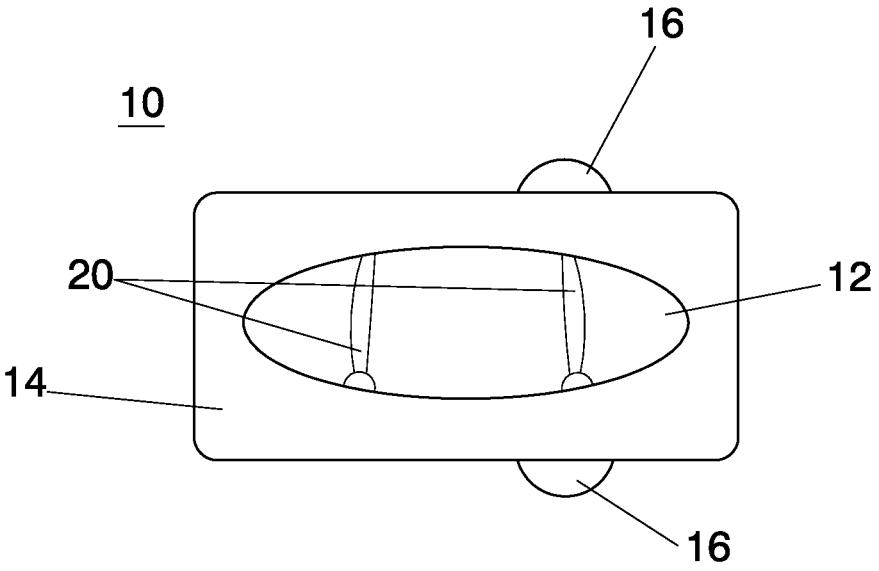
FIG. 1 shows a schematic top view of the portable device according to an embodiment of the present invention.
Figure 2:
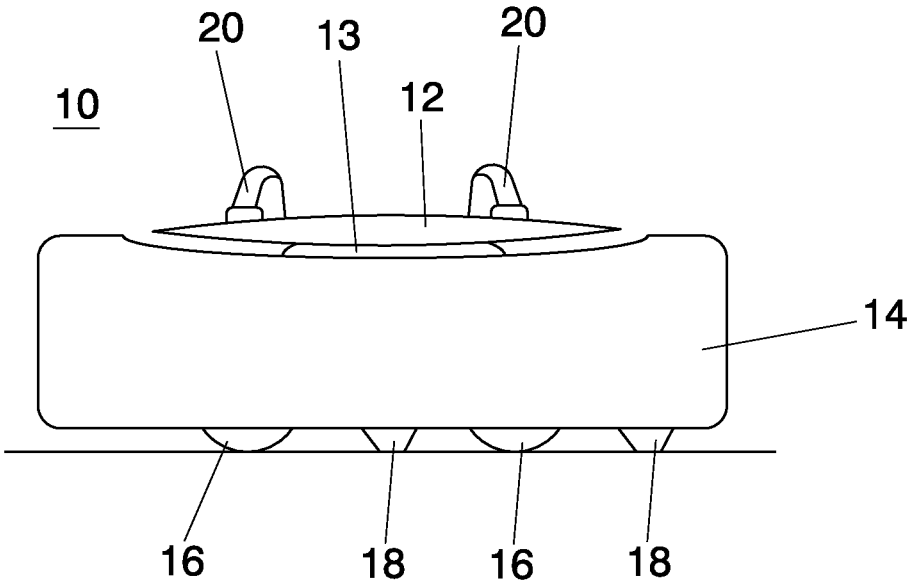
FIG. 2 shows a schematic view of the long side of the device depicted in FIG. 1.
Figure 3:
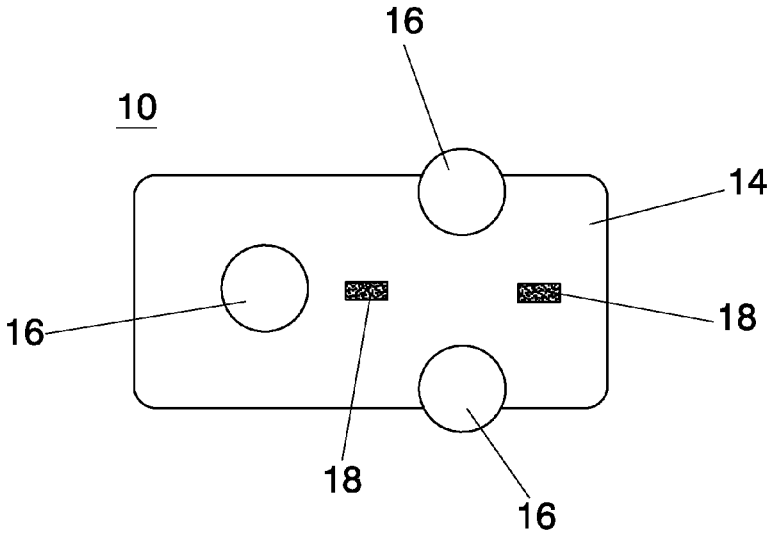
FIG. 3 shows a schematic bottom view of the device depicted in FIG. 1.
Figure 4:
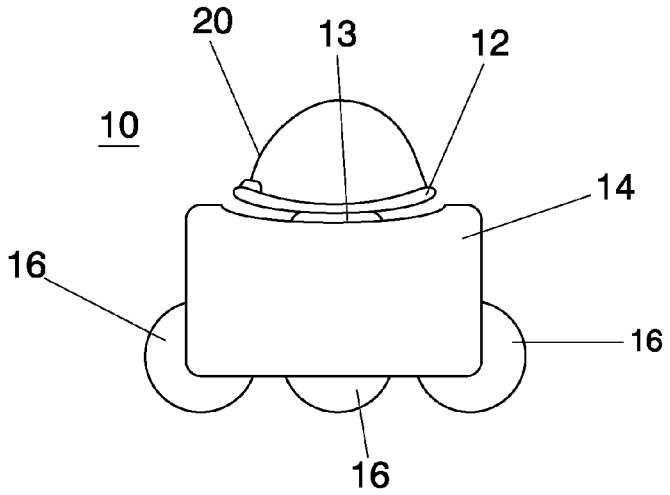
FIG. 4 shows a schematic view of the short side of the device depicted in FIG. 1.
Figure 5:
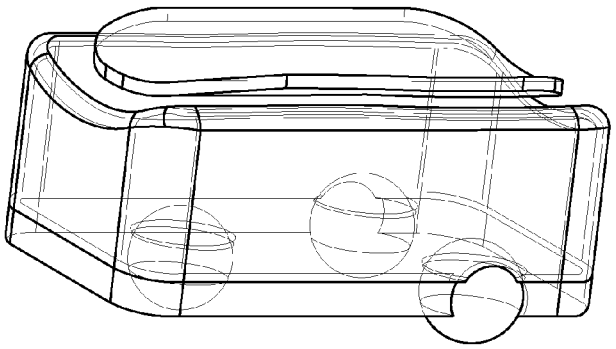
FIG. 5 shows a simplified three dimensional view of the device depicted in FIG. 1.

Referring now to FIGS. 1-5, an exemplary embodiment of the portable device 10 according to the invention will be described. The portable device, also referred to in this description as mobile unit or mobile robot, is composed of a device base 14, also referred to in this description as mobile platform with three spherical wheels 16, arranged at the vertexes of an equilateral triangle, that enable the displacement of the portable device. Alwayse or Omnitrack or similar commercial ball transfer devices may be used as passive spherical wheels. An armrest 12, whereto the forearm of the user can be fastened, is connected to the mobile platform. An optical tracking device is embedded into the mobile platform 14 so that the position and orientation of the device can be computed, while it moves.

The optical tracking device is composed of two optical mouse sensors 18. One of the two sensors is placed in the center of the mobile platform; the other one is placed at distance L from the center and in the direction of the long axis of the armrest. The reading of the two sensors provides a relative position measurement. The system is calibrated at the beginning of the use by putting it in a predefined position and orientation.

Referring now to FIG. 9, if $P\equiv(Xp,Yp)$ is the position of the central optical sensor and $Q\equiv(Xq,Yq)$ is the position of the other sensor with respect to the orthogonal reference frame centered in the initial position of P (Po), X axis from P to Q and Y axis and oriented so to have Z axis pointing upward from the table surface, then the position of the device at each instant is (Xp,Yp) and the orientation of the device (angle of the long axis of the armrest with respect to its initial position) can be computed with simple trigonometric formulas. For example for $(Xq-Xp)>0$ and $(Yp-Yq)\geq 0$, $\beta=a\tan((Yp-Yq)/(Xq-Xp))$. The extension of this formula, or other equivalent formulas, to cover full orientation space is evident to those skilled in the art.

Figure 6:
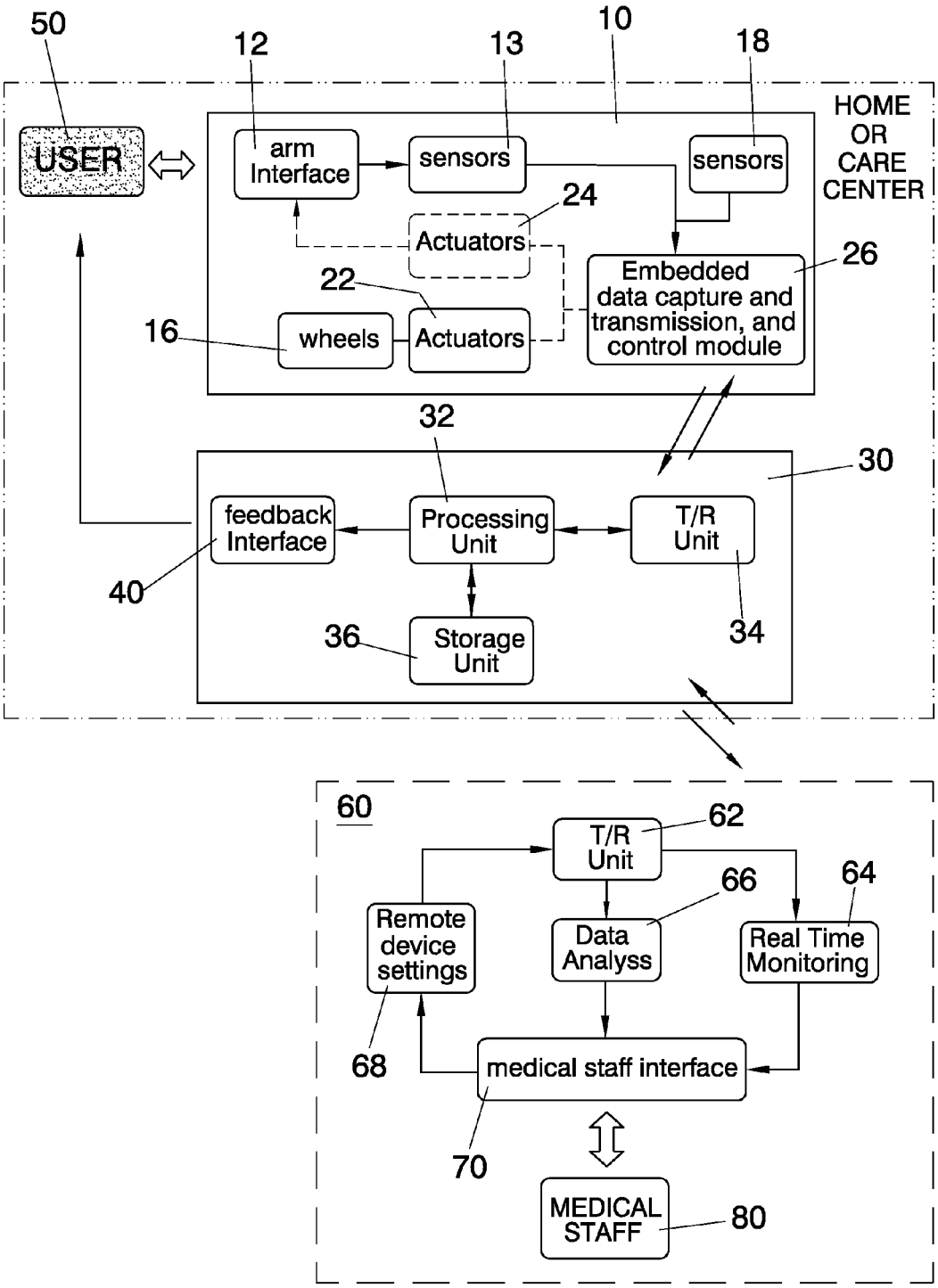
FIG. 6 shows a block diagram of a rehabilitation system according to an embodiment of the present invention.

The portable device depicted in FIGS. 1-5 may advantageously be used in a system depicted in FIG. 6, which is composed of three principal units: the portable device 10 used to passively or actively support a limb against gravity while allowing unconstrained planar motion, a feedback and computation unit 30 and a remote control and visualization unit 60. Moreover, a pad (with a textured polymer surface or polyester surface or similar) can be used to offer a suitable surface for the motion of the portable device 10. The pad can include some specifically designed obstacles or paths or three dimensional structures where the mobile device can be driven.

The mobile platform 14 hosts an embedded processing unit 26 (like a Gumstix™ module or similar) that has analog input expansion, digital input/output expansion, and wired/wireless communication expansion. The analog input expansion accepts signals from the force/torque sensors 13 measuring the force exerted on the armrest 12, from the optical sensors (18), or both.

In one embodiment of the device, the armrest 12 is equipped with a 3 DoF force sensor that monitors forces on the vertical axis and on the two axis that identify the plane parallel to the horizontal surface. The force sensor can be implemented by using strain gauges or similar techniques as done in commercial products (ATI force/torque sensors or similar). The armrest can be also equipped with a damping device that allows for a limited and selectable excursion of the armrest on the vertical axis when a force is applied on that axis. The armrest is also provided with Velcro straps or other similar means 20 to fasten the patient's arm to the mobile device.

The portable device may comprise actuators 22 for providing an assisted movement or active movement of the mobile base and actuators 24 for controlling the armrest height with respect to the device base and/or compliance to vertical forces.

The feedback and computation unit 30 comprises a processing unit 32, a transceiver unit 34 for transmitting data to and receiving from the embedded processing unit 26, a storage unit 36 and a feedback interface 40 for providing the feedback to a user 50.

The feedback and computation unit 30 provides the visual and/or acoustic and/or haptic feedback allowing the patient to act in a virtual scenario by means of the impaired arm supported by the portable device 10. In one embodiment the feedback and computation unit is composed of a screen (LCD or other commercial screen) and audio speakers, communicating with a commercial PC. The PC can acquire data transmitted via a wireless link from the sensors placed on the portable device 10, or from sensor placed in the environment, or on the user body, or both. The wireless transmission can be realised by using the 802.11 protocol or similar (for example WUSB, etc.). A game like software runs on the PC and the user plays in order to perform the rehabilitation tasks. The software also performs raw data collection and user performance statistics calculation and collection by means of purposely written routines. Moreover, the software has the ability to send data to a server present in the medical center via a standard Internet connection. The software can also receive new sets of parameters to tune the rehabilitation tasks according to medical staff decisions in the medical center.

The remote control and visualization unit 60 is composed of a standard PC that has means for transmitting and receiving information 62 to and from the feedback and computation unit 30, such as an Internet connection. This PC is used by the medical staff 80 to monitor and control the rehabilitation procedures carried by patients at home. The software running on this PC gathers information from all the clients through an encrypted connection to preserve patient's privacy. Information is stored on permanent memories such as, but not limited to, hard-disks. A data backup system and a UPS system can be also provided. The software may be used for real time monitoring (block 64) of a patient. The software can display information by means of several GUIs 70 and can compute and show data statistics and other information useful for the medical staff to monitor the rehabilitation training process (block 66). The medical staff can also use the software to set the parameters of the portable devices (block 68).

Now a number of exemplary use cases of the system described herein above are included as a mean to clarify certain possible uses of the present invention. Those use cases do not represent limitations of the invention.

In a typical scenario the system can be used to administer therapy to reduce gravity induced lack of coordination in patients with unilateral brain injuries. In fact, it is known that specifically designed training tasks can help chronic stroke patients to significantly reduce abnormal torque patterns generations and thus to improve reaching area and velocity of movement execution (Ellis et al., Muscle Nerve. 2005 August; 32(2):170-8).

According to this scenario, the patient is initially in the care center, where his/her condition can be evaluated by means of the proposed system. The information recorded is stored to serve as a reference. After the evaluation, the medical staff chooses a therapy program and configures the system software, accordingly. The patient can then be instructed on how to use the system properly. The medical staff also decides whether the patient should start the therapy in the care center or he/she could be sent home to continue the therapy with the portable device. When at home (or even in the care center) the patient can perform the exercises without the need of constant assistance and his progress can be monitored remotely by the medical staff who can adjust training exercises according to the improvements in patient condition.

As shown in FIG. 7, while using the device the user 50 sits comfortably in front of the table 110 whereon the portable device 10 is placed. A specific pad 120 may be used depending on the implementation. He/she fixes the fore arm 140 of the impaired arm to the armrest by means of strap belts or any other fastening system provided by the device. The system can then be turned on and it performs self checks and may ask the patient to perform simple task to complete a calibration phase. After completing self-check and calibration the system will initiate the training session, starting from the portable device's initial position 130.

In a typical scenario the feedback and computation unit 30 comprises a video screen (LCD or other) and audio speakers that are connected to the processing unit 32 receiving data from the portable device 10. The video screen and the speaker present the user with an interactive game he has to play to perform the training task. The portable device 10 acts as the input device for the game.

Moreover, the system could be connected to a specifically designed server 100 enabling group therapy. In this way several users can carry out training at the same time, receive information on the activity of the others, and compete or collaborate as part of the training.

The group therapy could take the form of an on-line CRPG (online computer role playing game) or MMORPG (massively multiplayer online role-playing game). FIG. 8 depicts a block diagram of such a concurrent rehabilitation concept. Impaired users IU 1 . . . n utilize the part of the system described in FIG. 6 and labeled 'home or care center'. Non-impaired users NU 1 . . . n use commercial input devices (joysticks, keyboards, etc.). Medical staff in the care centers 90 utilizes the part of the system described in FIG. 6 and labeled 'care center'.

In this way several training modalities became available:

(1) The user can be connected to a "virtual rehabilitation center" (maybe inside an Internet-based virtual world like Second-Life or others) and follow the instruction of a therapist together with other users;

(2) The user can carry out the rehabilitation task as a part of a team game with other users that are also training;

(3) The user can play a game together with non-impaired people that use conventional input devices in order to interact in the game. All those modalities have the potential to introduce a "recreational" or "fun" dimension into the rehabilitation routine that can improve the acceptability and the outcome of the therapy itself.

In a typical situation, the training involves the execution of a reaching movement combined with an arm lifting (shoulder abduction). The user has his forearm fixed to the portable device 10. The device is free to move on a table surface. The reaching movement causes the device to move on the table with the position sensors 18 recording relative position and orientation of the portable device 10 and thereby of the armrest 12 and the forearm fastened thereto. In a typical case the user will not be able to perform the shoulder abduction plus the reaching correctly without help due to for example abnormal synergies developed after a stroke. Nevertheless, the armrest support will allow him to counteract those synergies since he is not obliged to lift the arm weight.

In this simple case the armrest 12 has a fixed position with respect to the mobile base that allows for isometric shoulder abduction training. The force exerted by the forearm on the armrest is monitored by the force sensors 13 embedded into the armrest-to-mobile-base connection. Thus, the user can measure his progresses in the ability of lifting the arm while performing a reaching movement because he will be able to see a decrease of the force measured by the force sensor. In the ideal case, the user should be able to completely support the weight of his arm while performing the reaching task.

In more complex cases the vertical displacement of the armrest with respect to the base can be controlled by a damping system, or can be assisted by some actuators, so that more complex rehabilitation patterns can be implemented.

In any case, the position, orientation and force measurement constitute inputs that can be used to interact with game-like training software. The software can be very simple, like a 2D game. For example the user moves in a simple labyrinth by using the position and orientation of the forearm while accomplishing tasks by trying to lift the arm (overcome obstacles, reach for hanging bonus points, etc.). In more complex scenarios, the device can be used to interact in a multi-user online game and/or an internet-based virtual world, with other impaired users or with able-bodied users. In this way the social and recreational dimension added to the rehabilitation training could speed it up and/or make it more effective.

While the invention has been illustrated and described in detail in the drawings and foregoing description, such illustration and description are to be considered illustrative or exemplary and not restrictive; the invention is not limited to the disclosed embodiments.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. Portable device for rehabilitating an impaired user having difficulties in executing simultaneous reaching and lifting tasks, the portable device comprising:

an armrest for a forearm of the user, means for enabling a movement of the armrest on a surface, means for monitoring the movement of the armrest and means for sensing a force exercised by an arm of the user in an orthogonal direction to the surface, a fastening means for fastening the forearm to the armrest and wherein the means for sensing the force are adapted to measure a lifting force exerted by the arm of the user.

2. Portable device according to claim 1 wherein the means for enabling the movement of the armrest are spherical wheels or regular wheels.

3. Portable device according to claim 1 wherein the means for enabling the movement of the armrest consist of a flat base that can be dragged on a pad.

4. Portable device according to claim 1 further comprising at least an actuator for providing an assisted movement or active movement to a mobile base, the armrest being connected to the mobile base.

5. Portable device according to claim 1 wherein the portable device is used to passively support the forearm.

6. Portable device according to claim 1 comprising at least a braking system for controlling the movement of a mobile base, the armrest being connected to the mobile base.

7. Portable device according to claim 1 wherein the means for sensing a force exercised by the arm of the user comprise at least a force sensor.

8. Portable device according to claim 1 wherein the means for monitoring the movement of the armrest are adapted for monitoring the position, and/or velocity, and/or acceleration, and orientation of the armrest, wherein the orientation is defined as an angle of a long axis of the armrest with respect to its initial position, and comprise at least one position sensor.

9. Portable device according to claim 1 further comprising a base providing the means for enabling the movement of the armrest on the surface, the armrest being connected to the device base.

10. Portable device according to claim 9 comprising means for fixing the armrest at different heights with respect to the device base.

11. Portable device according to claim 9 wherein the armrest is equipped with at least an actuator for controlling the armrest height with respect to the device base.

12. Portable device according to claim 9 wherein the armrest can rotate freely, or by means of controlled actuators along its principal axis in order to accommodate for forearm pronation-supination movements.

13. Portable device according to claim 1, wherein the fastening means are selected from the group of: Velcro straps, pneumatic bracelets, 3D printed bracelets or clips, deformable fixation clips.

14. Portable device according to claim 1 further comprising joint position measurement means for directly monitoring the user's wrist, elbow and shoulder joints.

15. A system comprising:

a portable device for rehabilitating an impaired user having difficulties in executing simultaneous reaching and lifting tasks, the portable device comprising an armrest for a forearm of the user, means for enabling a movement of the armrest on a surface, means for monitoring the movement of the armrest and means for sensing a force exercised by an arm of the user in an orthogonal direction to the surface, a fastening means for fastening the forearm to the armrest and wherein the means for sensing the force are adapted to measure a lifting force exerted by the arm of the user; and a feedback and computation unit comprising a central processing unit, a storage unit, a feedback interface and a wired or wireless communication unit.

16. System according to claim 15 wherein the feedback and computation unit is equipped for implementing visual, or acoustic, or haptic feedback, or a combination of those.

17. System according to claim 15 wherein the feedback and computation unit is adapted for providing the user with an interactive game to be played for performing a training task by means of the portable device whereto his/her forearm is attached.

18. The system according to claim 15 wherein the system is adapted to be used for group therapy where the user can compete or collaborate with other users on a training task.

19. The system according to claim 15 wherein the system is adapted to be connected to a gaming server for interacting with a multi-user online game and/or an internet-based virtual world.

20. System according to claim 15 further comprising means for providing Functional Electrical Stimulation (FES).

21. System according to claim 15 further comprising means for Electromyography (EMG) monitoring of the arm muscles.

22. System according to claim 15 further comprising means for Electroencephalography (EEG) monitoring of brain patterns of activation during the rehabilitation.

23. System according to claim 15 further comprising a set of low resolution Complementary Metal Oxide Silicon (CMOS) or Charge Couple Device (CCD) cameras for video monitoring training movements of the arm qualitatively and/or quantitatively.

24. System according to claim 15 further comprising a pad containing zones with different heights.

25. System according to claim 15 further comprising a remote control and visualization unit to be used by medical staff to monitor and control rehabilitation procedures of patients comprising a processor, which has means for transmitting and receiving information to and from the feedback and computation unit.

26. System according to claim 25, wherein the remote control and visualization unit comprises means for setting parameters of portable devices.

27. System according to claim 25 wherein the means for transmitting and receiving information to and from the feedback and computation unit use an encrypted connection.

* * * * *